US006307135B1

(12) United States Patent
Hoshino

(10) Patent No.: US 6,307,135 B1
(45) Date of Patent: Oct. 23, 2001

(54) SUPPORT LEG OF A BASS DRUM

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/624,726

(22) Filed: Jul. 25, 2000

(30) Foreign Application Priority Data

Dec. 22, 1999 (JP) ..... 11-009755

(51) Int. Cl.[7] ..... G10D 13/02
(52) U.S. Cl. ..... 84/421; 84/327; 84/411 R
(58) Field of Search ..... 84/421, 327, 411 R

(56) References Cited

U.S. PATENT DOCUMENTS 4,640,175 2/1987 Hoshino ..... 84/421
4,700,437 * 10/1987 Hoshino ..... 24/456
4,796,508 * 1/1989 Hoshino ..... 84/421
5,408,913 * 4/1995 Hoshino ..... 84/421

* cited by examiner

*Primary Examiner*—Shih-Yung Hsieh
(74) *Attorney, Agent, or Firm*—Ostrolenk, Faber, Gerb & Soffen, LLP

(57) ABSTRACT

A support leg for a base drum including a base fastened to the drum body, an inside member rotatably positionable with respect to the base, an outside member pivoted to the inside member the inside and outside members being clampable together to clamp a leg between them, and a threaded shaft with a nut for tightening the inside holding member to the base and clamping the inside member at a selected rotative orientation with respect to the base, whereby loosening of the clamping arrangement enables the length position of the leg to be adjusted and loosening the tightening nut enables the rotative orientation of the leg to be adjusted.

6 Claims, 7 Drawing Sheets

SUPPORT LEG OF A BASS DRUM

BACKGROUND OF THE INVENTION

The present invention relates to a support leg for a bass drum.

In the past, a support leg for a bass drum has been held freely rotatable with respect to the trunk of the drum body so that the leg will provide an obstacle to the transportation of the bass drum with the support leg. An example of this is disclosed in U.S. Pat. No. 4,640,175. This publication shows a support leg that becomes freely rotatable by operation of a single tightening nut. The length of the support leg is simultaneously made freely adjustable both for elongation and contraction.

However, it is troublesome to adjust the length and the rotation position of the support leg each time a bass drum is set up. A support leg which can continuously maintain a set length and position would be more convenient when the bass drum is to be set up.

SUMMARY OF THE INVENTION

The present invention provides a support leg for a bass drum which can accommodate rotation of the support leg without causing change in the length of the leg with respect to the drum body once the support leg length is set and wherein the leg can be quickly set without need for readjusting the length of the support leg when the bass drum is to be next set up. The invention concerns a support leg for a base drum including a base fastened to the drum body, an inside member rotatably positionable with respect to the base, an outside member pivoted to the inside member; the inside and outside members being clampable together to clamp a leg between them; and a threaded shaft with a nut for tightening the inside holding member to the base, clamping the inside member at a selected rotative orientation with respect to the base, whereby loosening of the clamping by the inside and outside members enables the length position of the leg to be adjusted and loosening the tightening nut enables the rotative orientation of the leg to be adjusted.

The support leg for the bass drum includes a leg of a bar-shape. It has a base that includes an installation part on its inner side for attaching the base to the bass drum body. The opposite outer side of the base includes a rotation surface. A positioning groove is formed in the rotation surface on the outer side. A rotary shaft stands up from the center of the rotation surface of the base. The outward tip region of the shaft is screw threaded.

There is an inside leg holding member which has an inside axial hole for fixing the leg. It has a through hole through which the rotary shaft extends. A cooperating inside rotary surface on the inside member cooperates with the rotation surface of the base, with the through hole as the rotation center of both surfaces. The inside rotary surface has a rib that is insertable into the groove formed in the rotation surface on the base. A tightening seat is formed on the outer surface of the inside member around the periphery of the through hole. An inside bearing part is formed at one radial side of the through hole. An inside leg holding groove formed in the outer surface of the inside member freely accommodates the leg lengthwise. The inside groove is radially between the central through hole and the inside axial hole. There is an outside leg holding member which has an outside axial hole at a position corresponding to a through part that accommodates the tightening seat and the inside axial hole. An outside bearing part on the outside member corresponds to the inside bearing part on the inside member.

An outside leg holding groove is formed in the inner surface of the outside member at a location and orientation that corresponds to the inside leg holding groove formed on the outer surface of the inside member.

A pivot axle is attached between the outside bearing part and the inside bearing part. A leg tightening member is freely installed in the inside axial hole and the outside axial hole by which the inside and outside members are tightened on the leg held in the grooves in their respective opposed surfaces. A tightening nut is screwed to the tip region of the rotary shaft.

Other objects and features of the invention are explained below with reference to the attached drawings.

DESCRIPTION OF A PREFERRED EMBODIMENT

Figure 1:
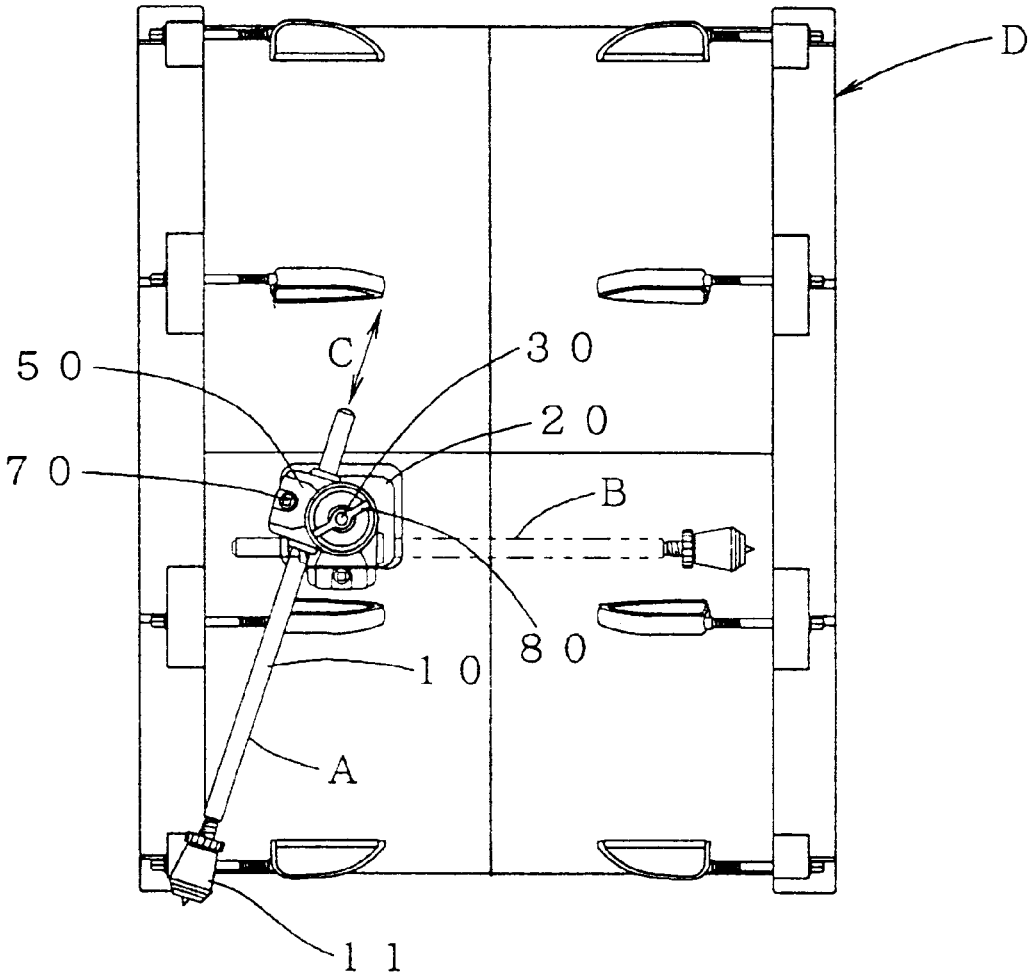
FIG. 1 is a front view of a support leg for a bass drum according to the invention shown positioned on a drum.

A support leg 10 is installed on the side of the main bass drum body D and is held at a set position A which is at a prescribed angle of incline to a vertical orientation, as shown in solid line in FIG. 1, which illustrates a condition when the bass drum is to be set up for use. The leg 10 is also freely rotatable around an axis that is essentially radial with respect to the drum body, so that the leg 10 may be held in the accommodating position B for example, in which the leg is parallel to the axis of the main bass drum body D, as shown in dotted line in FIG. 1, e.g. when the drum is to be transported. Also, the length of the leg 10 is freely expansible or contractible in the directions indicated by arrows C, when necessary. These two adjustments are mutually exclusive and one may be done without the other.

The support leg comprises a leg 10, a base 20 on the drum on which the leg is supported, a rotary shaft 30 extending out from the base for defining an axis about which the leg is rotated between positions A and B, an inside leg holding member 40 cooperating with the base, an outside leg holding member 50 cooperating with the inside member for clamping the leg between them, an axle 60 allowing the inside and outside members to pivot apart and together, a leg tightening bolt 70 clamping the holding members over the leg and a tightening nut 80 for fixing the rotative position of the holding member and the leg.

The leg 10 comprises a bar of a prescribed length with a leg tip 11 made of rubber.

Figure 2:
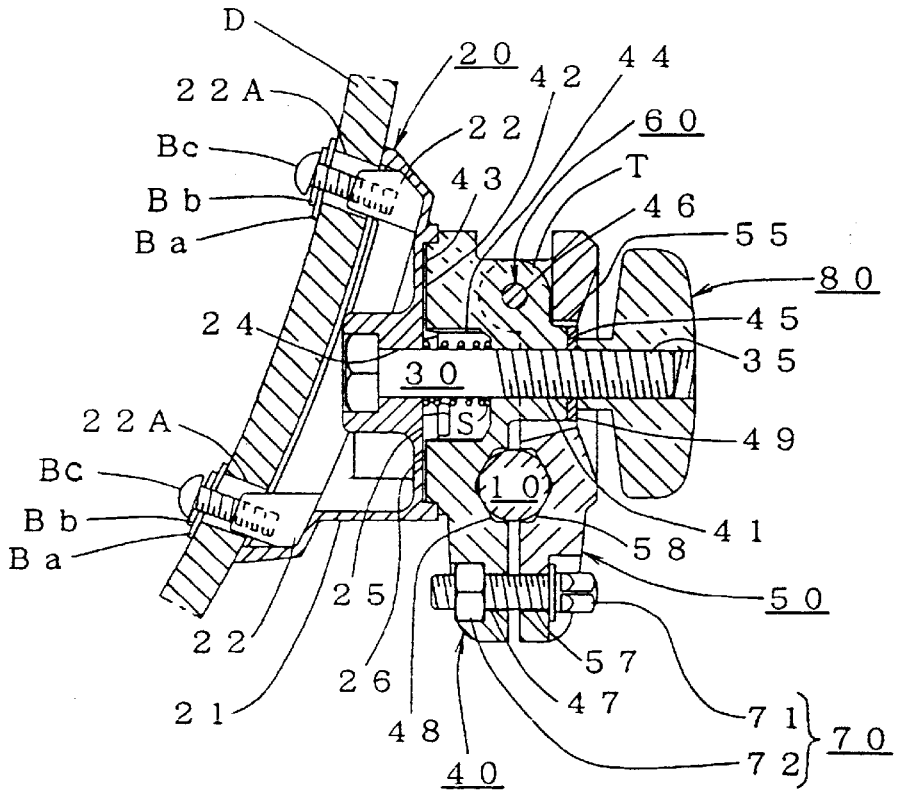
FIG. 2 is a cross section showing an essential part of the support leg.
Figure 3:
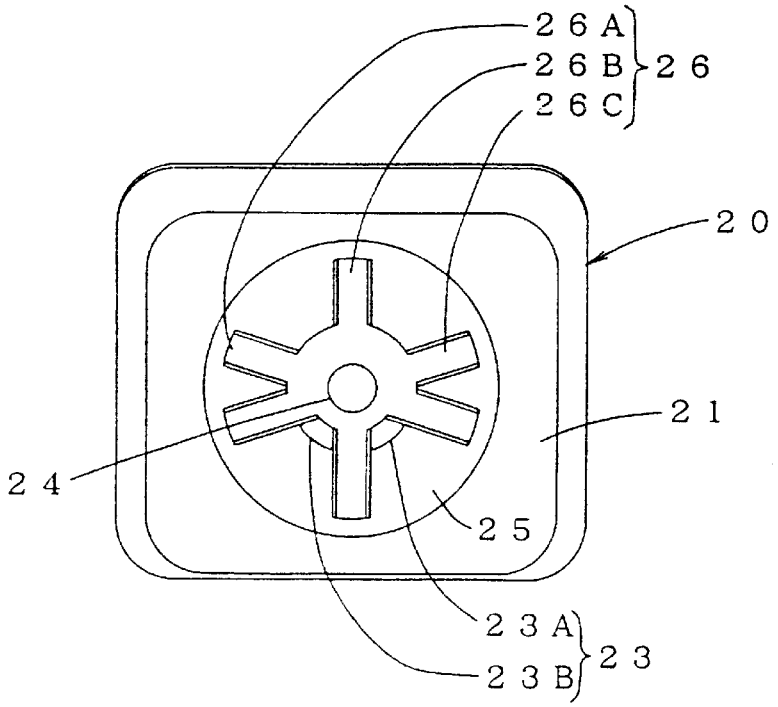
FIG. 3 is an elevational view showing the outer surface of the base.
Figure 4:
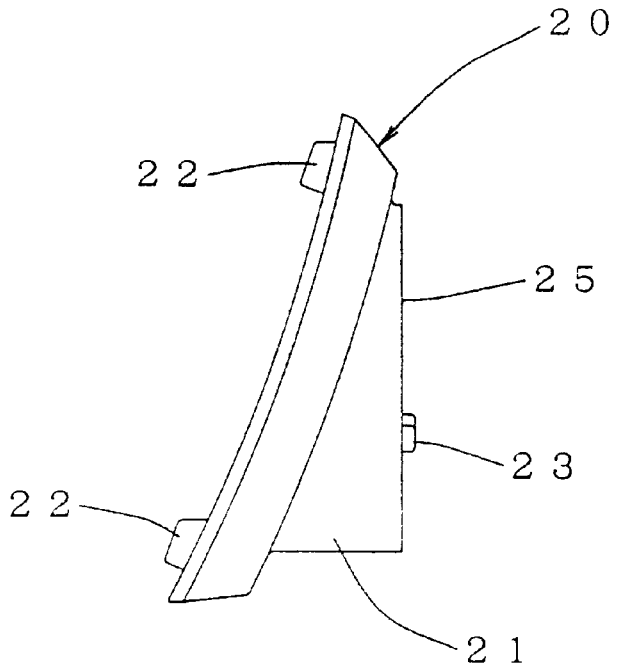
FIG. 4 is a left side view of the base.
Figure 5:
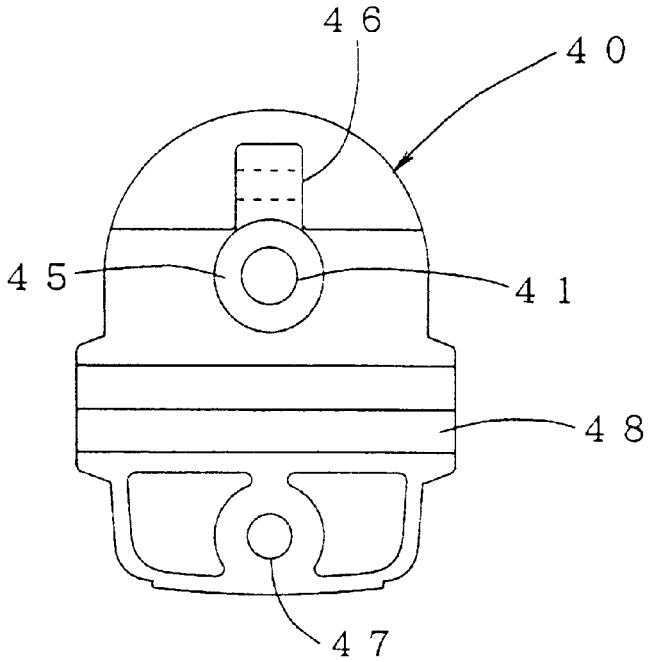
FIG. 5 is an elevational view of the outer side of the inside leg holding member.
Figure 6:
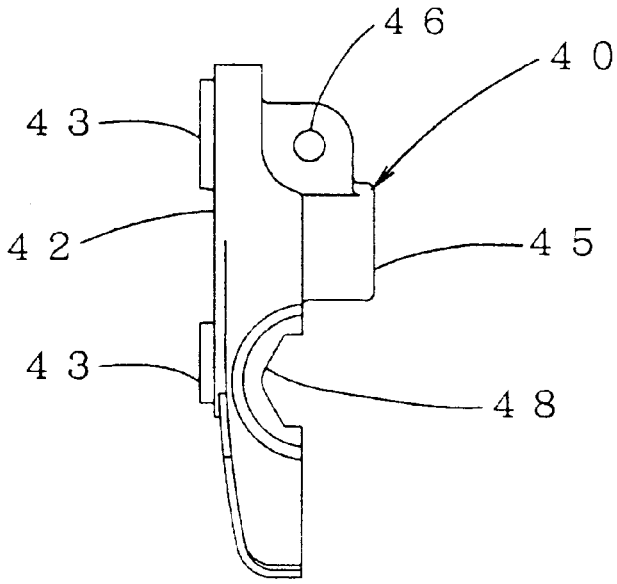
FIG. 6 is a left side view of the inside leg holding member.
Figure 7:
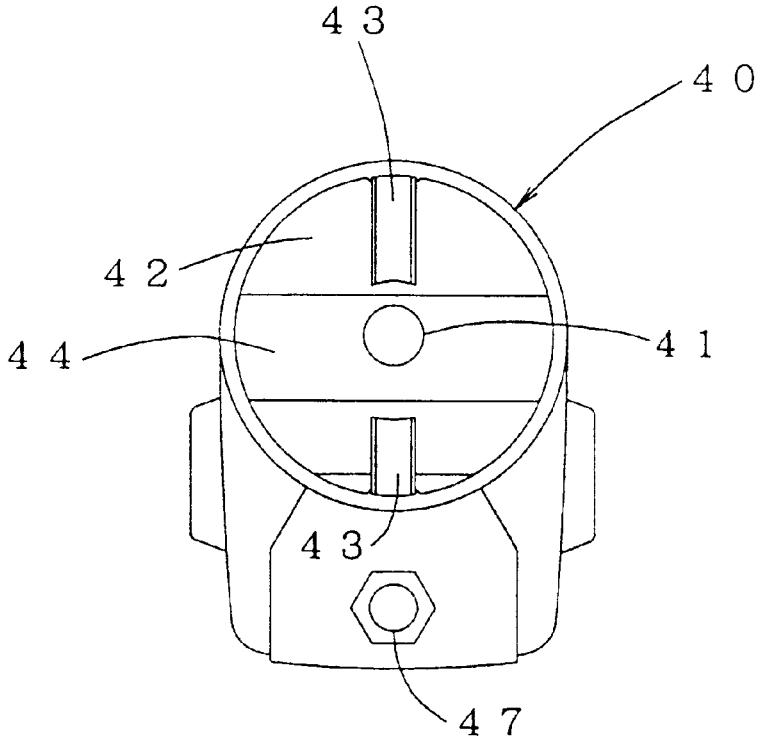
FIG. 7 is an elevational view of the inner side of the inside leg holding member.
Figure 8:
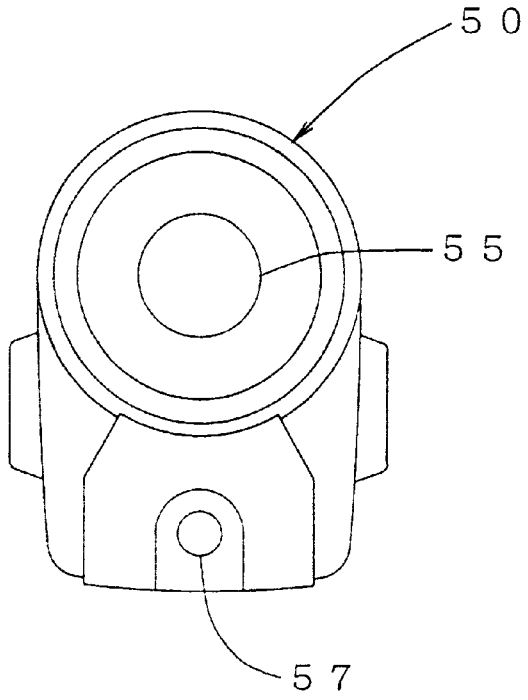
FIG. 8 is an elevational view of the outer surface of the outside leg holding member.
Figure 9:
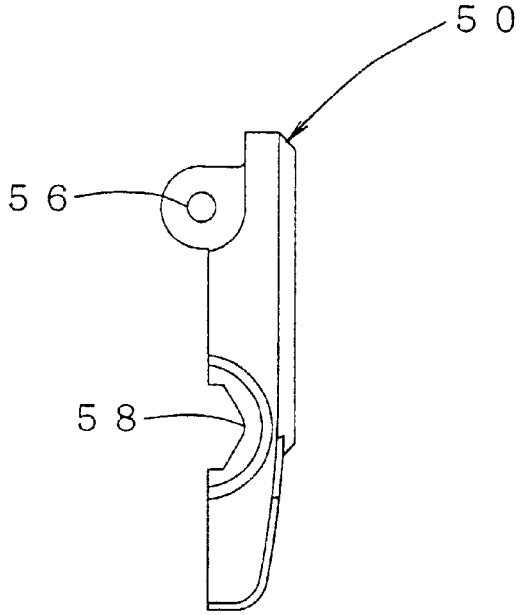
FIG. 9 is a left side view of the outside leg holding member.
Figure 10:
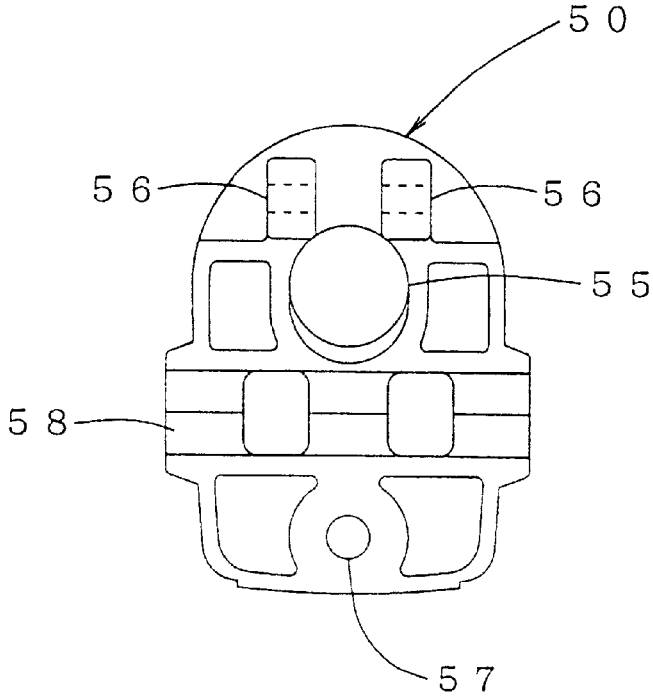
FIG. 10 is an elevational view of the inner surface of the outside leg holding member.

As shown in FIGS. 2 through 4, the base 20 has a main body 21 with an inner surface which carries installation parts 22 for installing the base 20 on the drum body D. Each installation part 22 comprises a protrusion that is positioned and clipped to be received in a respective base installation hole 22A provided in the bass drum body D. A respective bolt Bc is screwed from inside the bass drum body D into a screw opening in each installation part 22 for installing the base 20 on the bass drum body D. To aid this attachment, there is a respective washer Ba and a spring washer Bb at each bolt Bc.

Figure 11:
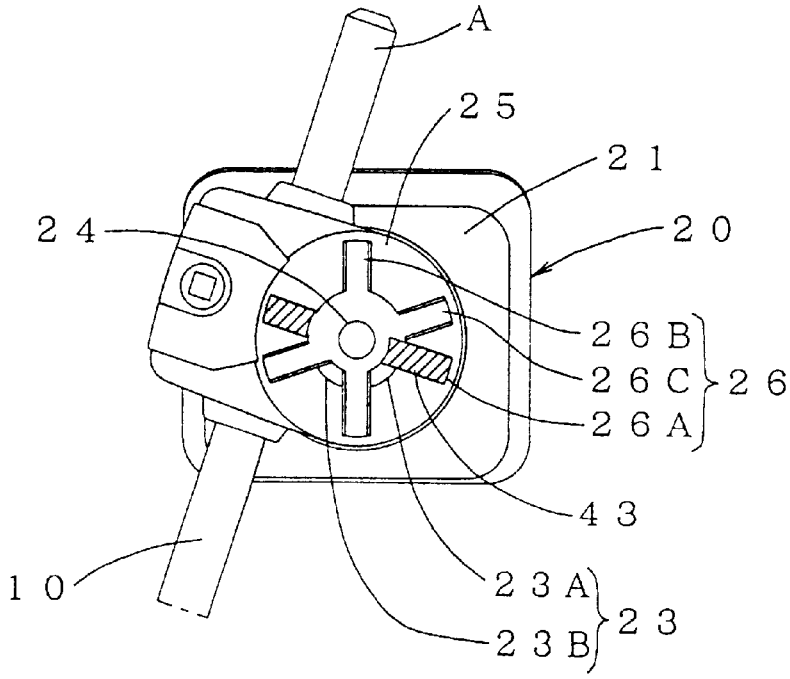
FIG. 11 is a fragmentary elevational view showing the leg held at a set position on the right side of the drum body.
Figure 12:
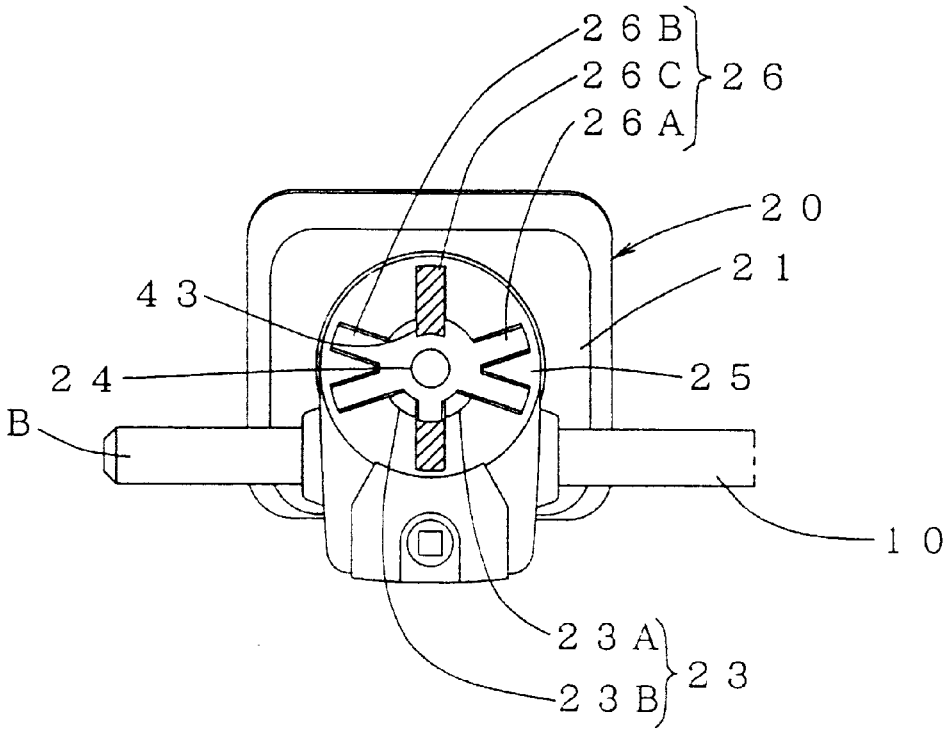
FIG. 12 is the same view showing the leg held at an accommodating position on the right side of the drum body.

The outwardly facing surface of the base 20 has rotation surface 25 formed on it, which is round in shape, as shown in FIG. 3. A positioning groove 26 for leg orientation is formed in the rotation surface 25. The groove 26 comprises three parts, a groove 26A for a right side leg, an accommodating groove 26B and a groove 26C for a left side leg. The groove 26A is used for installation of the leg 10 at the right of the drum body D, as shown by the set position A in FIG. 1 and in FIG. 11, which shows an expanded view of the essential part. The groove 26B is used during storage of the leg 10, for the accommodating position B in FIG. 1 and in FIG. 12. The groove 26C is used for installation (not shown) of the leg 10 at the left side of the drum body D.

A stopper 23 is provided on the rotation surface 25. There is a hole 24 at the center of the surface 25 for receiving the erected rotary axis 30. The stopper 23 comprises a stopper 23A for the right leg to be used when the leg has been installed on the right side of the drum body D and a stopper 23B for the left leg to be used when the leg 10 has been installed on the left side of the drum body D.

The rotary shaft 30 projects from the hole 24 at the center of the rotation surface 25 of the base 20, as shown in FIG. 2. The shaft 30 runs through the inside leg holding member 40. The tip region of the shaft is screw threaded at 35 and is screwed into the tightening nut 80.

The inside leg holding member 40 has a through hole 41 that runs through it to receive the rotary shaft 30, as shown in FIGS. 2 and 5 through 7. The inside member 40 has an inside rotary abutment surface 42 opposed to the rotary surface 25. The surface 42 has a rib 43 across its lower surface which is formed with the through hole 41 at its center. The rotary abutment surface 42 is shaped to abut the rotation surface 25 of the base 20. The rib 43 protrudes to be inserted into one part of the positioning groove 26 in the rotation surface 25 of the base 20, dependent upon the rotary orientation of the rotary abutment surface 42.

A concave 44 surrounds the through hole 41 on the inner surface of the member 40 for receiving a spring S that is wound around the rotary shaft 30.

A tightening seat 45 is formed around the peripheral edge of the through hole 41 on the outwardly projecting part of the upper surface of the inside leg holding member 40. The seat cooperates with the screwing on of a tightening nut 80 on the rotary shaft 30. A washer 49 contacts the tightening nut 80 at the tightening seat 45.

There is an inside bearing part 46 for the axle 60, described below. The bearing is formed on one radial side of the through hole 41. On the opposite radial side of the through hole 41, there is an inside axially directed hole 47 for installation of the leg clamping member 70. Radially between the inside axial hole 47 and the through hole 41, there are an outside leg holding groove 58, described below, and an inside leg holding groove 48 which cooperate for holding the leg 10.

Outward of the inside leg holding member 40, there is an outside leg holding member 50, as is shown in FIG. 2 and FIGS. 8 through 10. The outside leg holding member 50 has an opening 55 that accommodates the tightening seat 45. An outside bearing part 56 on the outside holding member is at a position corresponding to that of the inside bearing part 46. An axle 60, like a pin, etc. is attached between the outside bearing part 56 and the inside bearing part 46 to form a hinge T, enabling the inside leg holding member 40 and the outside leg holding member 50 to be pivoted opened or closed over the leg 10. It is desirable to make the side opposite the leg tightening member 70 described below into a hinge mechanism, as that will facilitate opening and closing smoothly.

The inside surface of the outside leg holding member 50 contains an outside leg holding groove 58 that is complementary to and overlaps the inside leg holding groove 48 in the inside holding member. An outside axially extending hole 57 is formed at a position that corresponds to the inside axially extending hole 47. The leg tightening member 70 is installed freely detachably in both the inside and outside axial hole 47 and 57.

As the inside leg holding member 40 and the outside leg holding member 50 are clamped together by the leg tightening member 70, this holds and then fixes the leg 10 by the walls of the inside and outside leg holding grooves 48 and 58. A bolt 71 and a nut 72 comprise the leg tightening member 70.

Operations involving mutually exclusive rotation of the leg 10 and adjustment of the length of the leg 10 are now explained.

For adjusting the length of the leg 10, the leg tightening member 70 installed in the inside axial hole 47 and the outside axial hole 57 is loosened. This opens the inside leg holding member 40 and the outside leg holding member 50 apart around the hinge T, thereby releasing the leg 10. The leg 10 may now be shifted in the directions along arrows C in FIG. 1, and the leg tightening member 70 is again tightened, thereby grasping the leg 10 again. In this manner, the length of the leg 10 may be freely adjusted.

For rotating the orientation of entire leg 10, the tightening nut 80 that is screwed tight on the rotary shaft 30 is loosened. This releases engagement between the positioning groove 26 on the base 20 and the rib 43 on the inside leg holding member 40 and enables the leg 10 that has been held by the inside leg holding groove 48 and the outside leg holding groove 58 to be rotated around the rotary shaft 30 as the center.

During rotation of the leg 10, it is easily possible to learn the prescribed holding position as the rib 43 of the inside leg holding member 40 touches the stopper 23A for the right leg for the leg 10 on the right of the main bass drum body D and the stopper 23B for the left leg 10 installed on the left of the main bass drum body D. When the prescribed holding position is achieved, the nut 80 is once again tightened thereby fixing the leg 10 to the base 20 at the selected rotation orientation.

The rotary shaft 30 and the tightening nut 80 are used for fixing the base 20 with respect to the inside leg holding member 40. This freedom for rotation is not related to the tightening or loosening between the inside leg holding member 40 and the outside leg holding member 50. As a result, it is possible to rotate the leg by loosening the tightening nut 80 while the leg 10 is being held by the inside leg holding groove 48 and the outside leg holding groove 58 and to rotate the leg to its set position and its accommodating position without changing the length of the leg 10.

The support leg for a bass drum as described above permits rotation of the entire support leg with respect to the main bass drum body while the support leg is being held and fixed. It is possible to rotate and store the support leg without changing its set length and position and to set the leg quickly without requiring adjustment of the length of the support leg for the next setup of the bass drum.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A support leg structure for a bass drum, comprising:

a base having a first inner side including an installation part thereon for attachment to a body of the bass drum;

the base having an opposite first outer side, a first rotation surface formed on the first outer side; a plurality of receiving grooves defined in and extending across the first rotation surface at different rotative orientations around an axis of the first rotation surface;

a shaft extending up from the first outer surface of the base at the axis;

an inside leg holding member having a second inner surface facing toward the first rotation surface of the base and having an opposite second outer surface, a hole through the inside member through which the shaft passes;

a second rotation surface on the second inner surface of the inside member for cooperating with the first rotation surface on the base enabling the inside member to be rotated with respect to the base with the shaft as the center of rotation;

a rib on the second inner surface of the inside member, the rib being shaped to cooperate with a selected one of the receiving grooves in the first rotation surface of the base, the selected groove being dependent upon the rotation orientation of the inside member with respect to the base;

the inside member having a tightening seat projecting outwardly and formed around the shaft hole of the inside member;

an inside leg holding groove defined in and extending across the second outer surface of the inside member for receiving a leg extending lengthwise through the leg holding groove;

an outside leg holding member outside of the inside leg holding member, the outside leg holding member having a third inner surface opposed to the second outer surface of the inside member, the outside member having an opening through which the tightening seat of the inside member projects outward;

the outside member including an outside leg holding groove defined in and extending across the third inner surface, the outside leg holding groove being oriented and positioned to overlie the inside leg holding groove on the second outer surface of the inside member to hold a leg in the overlying inside and outside leg holding grooves;

a clamping arrangement for clamping the inside and outside leg holding members together and over a leg held in the overlying inside and outside grooves for clamping a leg fixed in its lengthwise position with respect to the leg holding members;

a tightening arrangement on the shaft and extending between the base and the tightening seat on the inside member, including a tightening element being tightenable onto the shaft to tighten the base and the inside holding member together to retain the rotative orientation of the inside holding member with respect to the base.

2. The support leg structure of claim 1, further comprising a bar shaped leg disposed in the overlying inside and outside grooves respectively in the inside and outside holding members.

3. The support leg of claim 1, wherein the clamping arrangement comprises a pivot connection between the inside and the outside leg holding members, the pivot being to one side of the overlying grooves for enabling the leg holding members to be pivoted apart to open the overlying grooves for enabling movement of a leg therein and to be pivoted together to clamp the leg in the overlying grooves; and a clamping device for clamping the inside and outside leg holding members over the leg.

4. The support leg of claim 3, wherein the clamping device comprises a bolt and nut connection between the inside and the outside leg holding members and at the opposite side of the leg holding grooves from the pivot connection.

5. The support leg of claim 3, wherein the tightening arrangement comprises the shaft at the axis being threaded, and the tightening element comprising a tightening nut tightened on the threaded portion of the shaft and tightenable against the tightening seat on the inside holding member.

6. The support leg of claim 1, wherein the tightening arrangement comprises the shaft at the axis being threaded, and the tightening clement comprising a tightening nut tightened on the threaded portion of the shaft and tightenable against the tightening seat on the inside holding member.

* * * * *